US005143174A

United States Patent [19]

Davis

[11] Patent Number: 5,143,174

[45] Date of Patent: Sep. 1, 1992

[54] DISMOUNTABLE LADDER

[76] Inventor: William E. Davis, 915 Justice Dr., Tampa, Fla. 33613

[21] Appl. No.: 787,521

[22] Filed: Nov. 4, 1991

[51] Int. Cl.[5] ..... E06C 1/36; E06C 1/38

[52] U.S. Cl. ..... 182/151; 182/46; 182/206; 182/228

[58] Field of Search ..... 182/206, 178, 194, 228, 182/46, 151

[56] References Cited

U.S. PATENT DOCUMENTS

| | | | |
|---|---|---|---|
| 381,429 | 4/1888 | Scott | 182/206 |
| 1,177,557 | 3/1916 | White | 182/206 |
| 2,628,011 | 2/1953 | Buechler | 182/206 |
| 4,024,929 | 5/1977 | Mintz | 182/151 |
| 4,215,766 | 8/1980 | Littlefield | 182/46 |

*Primary Examiner*—Reinaldo P. Machado
*Attorney, Agent, or Firm*—Dominik, Stein, Saccocio, Reese, Colitz, & Van Der Wall

[57] ABSTRACT

A dismountable ladder for use with transom, swim or dive platforms having a pair of similarly shaped vertical upper side members. The upper end of each upper side member is formed as a U-shaped hook for releasably receiving a portion of a transom, swim or dive platform. The lower end of each upper side member has an opening. Additionally, a horizontal upper step member is releasably coupled within the opening in the lower ends of the upper side members. Finally, screws are provided for securing the upper step member to the upper side members through screw holes of the upper side members and upper step member.

9 Claims, 3 Drawing Sheets

DISMOUNTABLE LADDER

BACKGROUND OF THE INVENTION

1. Field of the Invention

This invention relates to a dismountable ladder and, more particularly, to a dismountable ladder comprising a pair of similarly shaped vertical upper sides formed at the top with downwardly depending U-shaped hooks for receiving a portion of a transom, swim or dive platform and formed at the bottom with openings for receiving a horizontal upper step for use with transom, swim or dive platforms thereby making access into and from a boat easier and safer.

2. Description of the Background Art

In the field of boat ladders, there have been a variety of devices designed to facilitate movement to and from boats. Commonly, a ladder or a unit comprising a platform and ladder is mounted to the transom of a boat for entering or exiting the boat. Additionally, ladders provide a convenient means of entering and exiting a boat that has been removed from the water.

Storage of boat ladders is essential when a boat is underway. Because of the space limitations inherent of boats, storage space on a boat is at a premium. The lack of storage space found available on a boat has greatly impacted the design of boat ladders. Many ladders have features incorporated into their design to facilitate their storage. Commonly, ladders are designed so that they remain exterior of the boat when the ladder is not in use or the boat is underway.

Typically, hinges are used to secure boat ladders to transom, swim or dive platforms that are permanently mounted to the transom of a boat. The hinged connections allow the ladder to swing into a position above the water's surface, but preclude the boat ladder from being portable from one boat to another boat.

As a result of most boat ladders are designed so that they can pivot about a fixed mounting point, the ladders are unable to adequately extend below the water line. If the boat ladders are constructed sufficiently long enough to extend below the water line, the length of the ladder precludes easy swinging of the ladder into the storage position or prohibits the ladder from resting on the top portion of a transom platform. Therefore, a method of extending boat ladders below the surface of the water is desirable.

The design of existing boat ladders precludes them from being easily transferred from one boat to another boat. Existing boat ladder designs do not permit boat ladders to be completely portable from one boat to another for depending downwardly from an existing ladder or transom, swim or dive platform into the water, thereby assisting a user to exit or enter a boat. In accordance with the present invention, any number of steps may be added.

The present invention is directed to improving known devices for providing access to and from a boat in a manner which is safe, secure, convenient, economical and aesthetically pleasing.

The prior art discloses several types of boat ladders for providing access to and from boats. By way of example, U.S. Pat. Nos. 3,195,680 to Thornburg Et Al, 3,794,140 to Sell, 4,712,503; 4,726,317; 4,735,285 and 4,768,618 to Ritten disclose ladder devices for mounting to the transom of a boat. The devices comprise a platform unit and step unit. Patent '680 to Thornburg discloses bracketry for receiving the platform unit to allow the platform unit to be removed from the boat's transom. Patents '285, '680, and '140 pivotally mount the step unit to the platform unit for allowing the step unit to be swung upwardly toward the boat to rest on to of the platform or against the boat when the step unit is not in use. The step unit can be swung downwardly and away from the boat to below the waterline to allow access to and from the boat. Alternately, Patent '285 to Ritten discloses a step unit that retracts to a position under the platform unit when the step unit is not in use. A pair of rings are secured to the platform unit to facilitate retracting the step unit. All the boat ladders in '680, '140, '503, '317, '285, and '618 disclose fixed hinges to allow the step unit to be pivoted with respect to the platform unit. The disclosed fixed hinge does not facilitate easy removal of the step unit, nor does the fixed hinge allow extra interlocking step units to be added to the boat ladder.

A variation of boat ladders having a platform unit and a step unit is disclosed in U.S. Pat. No. 4,541,507 to Gibellato. the platform unit in '507 is adapted to be mounted to a tubular structure. The step unit is mounted to the platform unit by fixed hinges for allowing the step unit to pivot about the platform unit. The fixed hinge disclosure in '507 is not conducive to easy removal of the step unit or addition thereto. Nor is there any teaching to add extra interlocking step units to a boat ladder.

Additional ladders are shown in U.S. Pat. Nos. 2,941,617 to Stifler, 3,804,200 to Sandberg and 4,231,448 to Jensen. Patent '617 discloses an apparatus that comprises an auxiliary ladder rung that is clamped to the rails of an existing ladder. The clamping members allow the rungs to be adjusted vertically and interlocking rings and pins are disclosed for allowing the width of the ladder to be adjusted. However, the disclosure does not offer the advantages of easy removal or additions thereto.

Patent '200 discloses a step unit adapted to be permanently pivotally coupled to the lower end of a boat ladder. The step unit has arms projecting from one end with counterweights attached thereto. The counterweights serve to swing the step unit out of the water when the boat is underway. There are no provisions in the disclosure for easy removal of the step unit or addition thereto.

Patent '448 teaches a ladder that is suspended from the deck or side of a boat. Offset crank-like hangers are formed to pass over the gunwales of the boat without contacting them and secure to corresponding anchoring plates permanently secured to the boat's deck. The disclosure provides for hanging the ladder unit from the side of the boat without provisions for pivoting the ladder into a storage position when the ladder is not in use. Nor does the disclosure teach adding additional step units to the ladder for providing easier access to and from the boat.

Lastly, U.S. Pat. No. 2,148,958 to Myers illustrates a step attachment apparatus for hanging a step from a conventional ladder. The apparatus is designed to provide a flat step for the user to stand upon, thereby reducing tiring of the user's feet and other body parts that normally results from standing on ladder rungs. The disclosure does suggest any teaching for adding interlocking steps to an existing boat ladder or transom, swim or dive platform for enabling the user to chose a stepping height that is comfortable, safe and convenient for them. Nor does the disclosure teach a method of swinging the step unit up to rest on top of a transom, swim or dive platform, remaining ready to use at anytime.

None of the prior art patents teaches or suggests the safe, secure, convenient, economical and aesthetically pleasing arrangement of providing access to and from a boat as described herein.

As illustrated by the prior art patents, and known commercial devices, efforts are continuously being made to improve boat ladders. None of the prior art efforts, however, suggest inventive combination of component elements arranged and configured as disclosed and claimed herein. Prior efforts do not provide the benefits attendant with the present invention. The present invention achieves its purposes, objectives and advantages over the prior art devices through a new, useful and unobvious combination of component elements, through of a minimum number of functioning parts, at a reduction in cost to the manufacturer, and through the utilization of only readily available materials and conventional components.

Therefore, it is an object of this invention to provide a dismountable ladder for use with transom swim or dive platforms. The dismountable ladder has a pair of similarly shaped vertical upper side members. The upper end of each upper side member is formed as a downwardly depending U-shaped hook and is adapted to releasably receive a portion of a transom, swim or dive platform. The lower end of each upper side member has an opening with screw holes extending from interior of the opening to exterior of the lower end of the upper side member. Additionally, a horizontal upper step member is releasably coupled within the opening in the lower ends of each of the upper side members. Finally, the upper step member has a plurality of screw holes therein and screws for securing the upper step member to the upper side members through screw holes of the upper side members and upper step members.

Another object of this invention is to provide access to and from a boat in a manner which is safe, secure, convenient and aesthetically pleasing.

A further object of this invention is to provide a boat ladder that can easily moved from boat to boat.

A further object of this invention is to provide a boat ladder that can easily be economically added to the transom, swim or dive platform of any boat.

A further object of this invention is to provide a dismountable boat ladder that can be assembled or disassembled quickly and easily.

A further object of this invention is to provide a dismountable boat ladder that is portable and can be removed from a boat easily and quickly.

A further object of this invention is to provide a dismountable boat ladder that can remain on a boat that is underway by swinging the dismountable boat ladder up to rest on top of a transom, swim or dive platform, thereby remaining in place and ready to use at any time.

Lastly, it is an object of this invention to add extra interlocking steps to a dismountable boat ladder.

The foregoing has outlined some of the more pertinent objects of the invention. These objects should be construed as merely illustrative of some of the more prominent features and applications of the intended invention. Many other beneficial results can be obtained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the spirit and scope of the invention as defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a dismountable ladder for use with transom, swim or dive platforms which includes a pair of similarly shaped vertical upper side members having upper ends formed as a downwardly depending U-shaped hooks adapted to releasably receive a portion of a transom, swim or dive platform. The lower end of each upper side member has an opening with screw holes extending from interior of the opening to exterior of the lower end of the upper side member. A horizontal upper step member is releasably coupled within the opening in the lower ends of each of the upper side members and has a plurality of screw holes therein. Screws are provided for securing the upper step member to the upper side members through screw holes of the upper side members and upper step members.

The dismountable ladder has step members with a plurality of holes at each end for allowing the side members to be positioned with a variety of distances therebetween. Furthermore, the tip of the end of the U-shaped hook has a bump thereon and the angle $\theta$ formed by the center line of the upper side member and the center line of the linear axis of the slot defined by the U-shaped hook means is 30 degrees. The dismountable ladder is constructed of a solid plastic material and employs number 10 stainless steel phillips panhead screws.

The dismountable ladder further includes a pair of similarly shaped vertical lower side members. The upper end of each lower side member has an opening for receiving the horizontal upper step member. The upper end cf each member also has screw holes extending from interior of the opening means to exterior of the upper end of the lower side member. The lower end of each member has an opening for receiving a horizontal lower step member. The lower step member is positioned forward of the upper step member when the ladder is positioned for use Screw holes extend from interior of the each opening to exterior of the lower end of the lower side member. A horizontal lower step member is releasably coupled within the openings cf the lower ends of the lower side members and has a plurality cf screw holes therein for securing the lower step member to the lower side members. Screws secure the lower step member to the lower side members and secure the lower side members to the horizontal upper step member.

Keeper ties are further included in the dismountable ladder. The keeper ties are for tying to a portion of a transom, swim or dive platform to preclude the ladder from separating from the transom, swim or dive platform.

The invention may also be incorporated into a dismountable ladder for use with a transom, swim or dive platform including a pair of similarly shaped solid plastic vertical upper side members. The upper end of each upper side member is shaped as a downwardly facing U-shaped hook with a bump on the end of the hook and is adapted to releasably receive a portion of a transom, swim or dive platform. The angle $\theta$ formed by the center line of the upper side member and the center line of the linear axis of the slot defined by the U-shaped hook is between about 25 and 35 degrees. The lower end of each upper side member includes an opening with screw holes extending from interior of the opening means to exterior of the lower end of the upper side member. Additionally, the dismountable ladder has a pair of similarly shaped solid plastic vertical lower side members. The upper end of each lower side member has an opening for receiving the horizontal upper step member. Screw holes extend from interior of the opening to exterior of the upper end of the lower side member. The lower end of each lower side member has an opening for receiving a horizontal lower step member such that the lower step member is positioned forward of the upper step member during operation and use of the dismountable ladder. Screw holes extend from interior of the opening to exterior of the lower end of the lower side member. Furthermore, a solid plastic horizontal upper step member is releasably coupled within the opening in the lower ends of the upper side members. The upper step member has a plurality of screw holes therein at each end for allowing the side members to be positioned with a variety of distances therebetween. Moreover, a solid plastic horizontal lower step member is releasably coupled within the openings of the lower ends of the lower side members. The lower step member has a plurality of screw holes therein at each end for allowing the lower side members to be positioned with a variety of distances therebetween In addition, screws are used for securing the upper step member to the upper side members through the screw holes of the upper side members and upper step member. Screws are also used for securing the lower step member to the lower side members and for securing the lower side members to the horizontal upper step member. Finally, keeper means are employed for tying to a portion of a transom, swim or dive platform to preclude the ladder from separating from the transom, swim or dive platform.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed herein may be readily utilized as a basis for modifying or designing the other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more complete understanding of the nature, object and advantages of the present invention, reference should be had to the following detailed description taken in conjunction with the accompanying drawings in which.

Similar reference characters refer to similar parts throughout the several drawings.

DETAILED DESCRIPTION OF THE INVENTION

Figure 1:
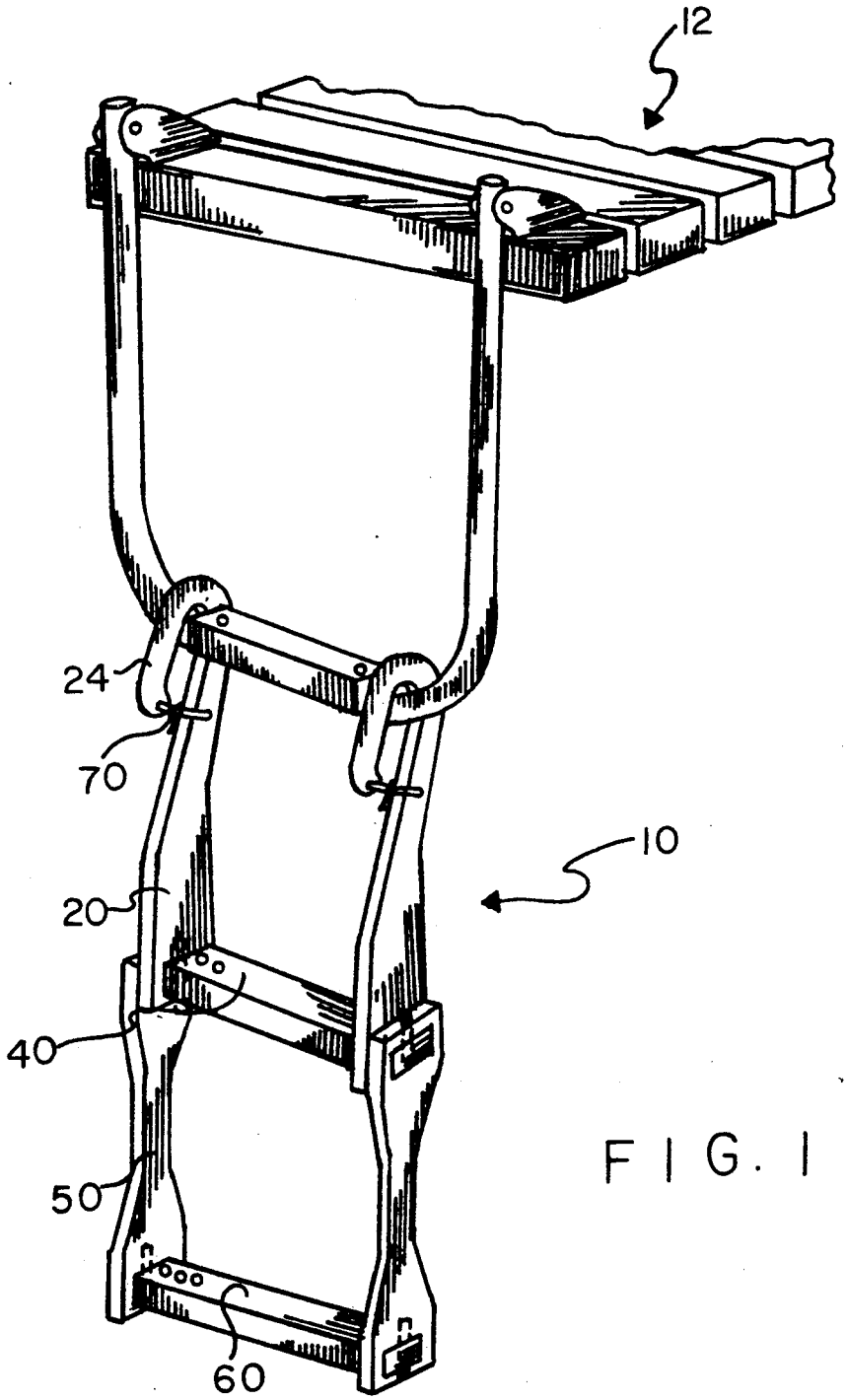
FIG. 1 is a perspective view of the present invention taken from one end thereof.
Figure 4:
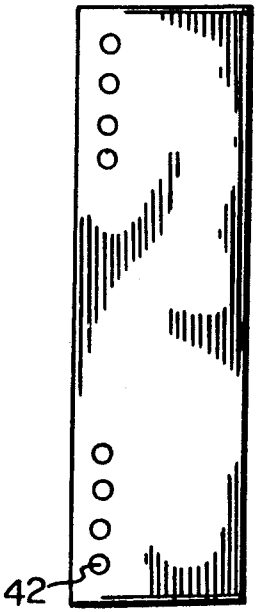
FIG. 4 is a top plan view of a horizontal step member of the dismountable ladder.
Figure 3:
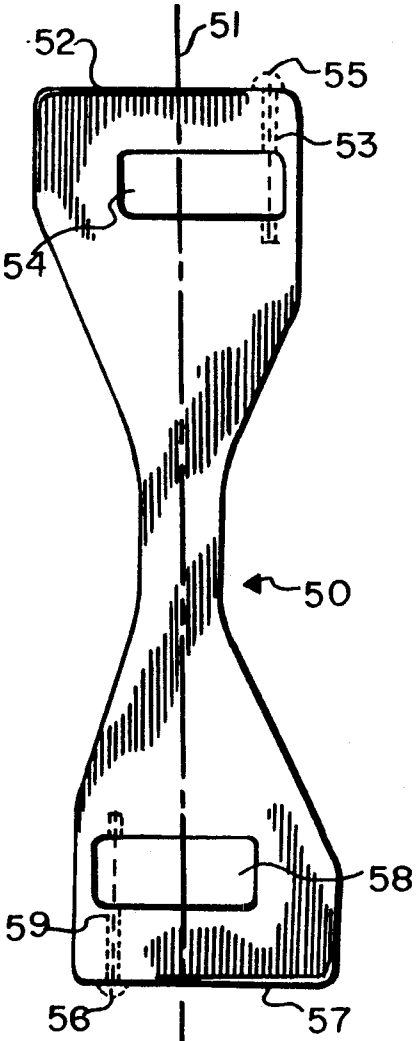
FIG. 3 is a side elevational view of a lower side member of the dismountable ladder.
Figure 2:
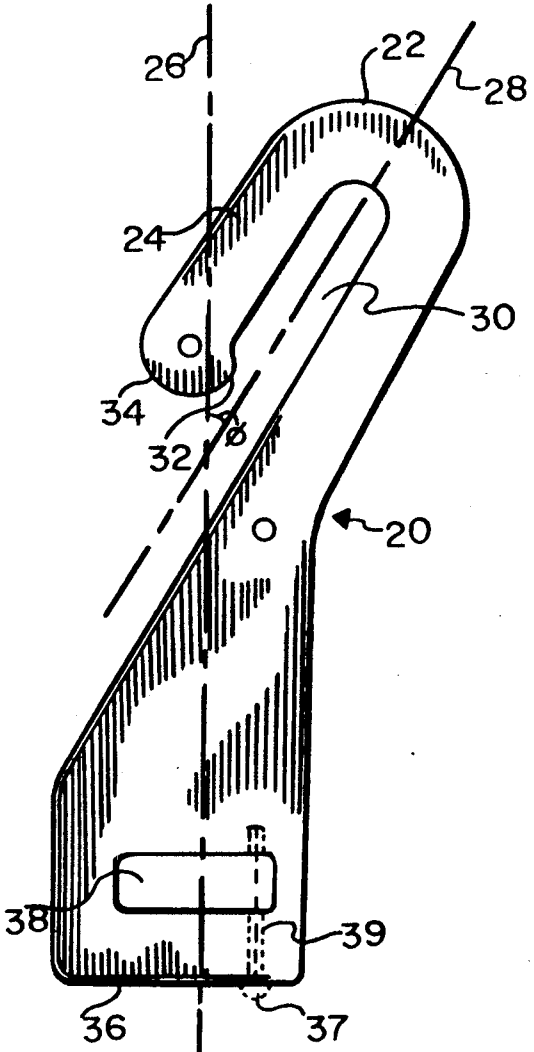
FIG. 2 is a side elevational view of an upper side member of the dismountable ladder.
Figure 5:
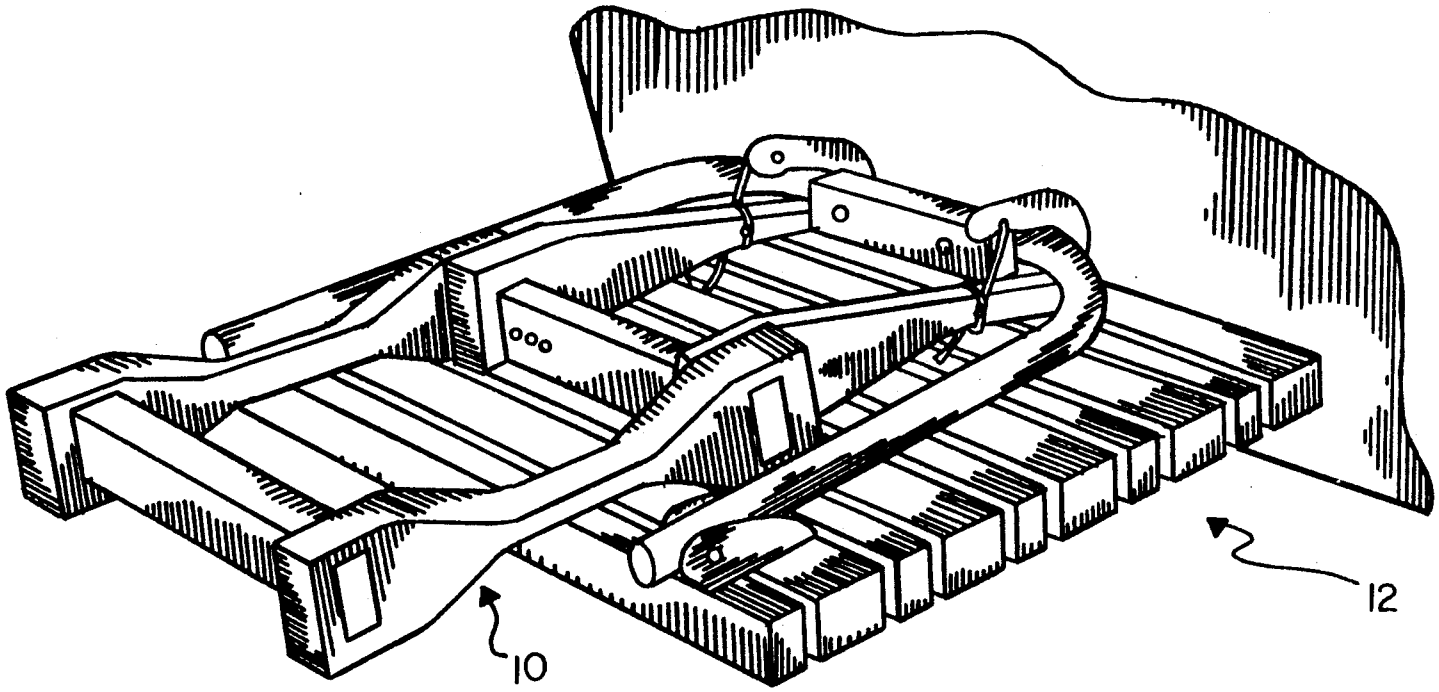
FIG. 5 is a perspective view similar to FIG. 1 but showing the dismountable ladder in the stored position.

Shown in FIGS. 1 through 5 are various views of the dismountable ladder constructed in accordance with the principles of the preferred embodiment of the present invention.

The dismountable ladder 10 is adapted to be coupled to the transom, swim or transom, swim or transom, swim or dive platform 12 of a boat (not shown). The dismountable ladder 10 is completely portable as a unit from one boat to another boat. Hooks 24 at the upper end 22 of the dismountable ladder 10 allow the ladder to be hung from a member of a transom, swim or dive platform 12 that is permanently mounted to a boat (not shown). The dismountable ladder 10 may consist of a single step member 40 or have additional step members 60 added thereto. The step members 40 and 60 of the dismountable ladder 10 have a plurality of screw holes 42 therein for allowing the width of the ladder 10 to be adjusted to fit a variety of transom, swim or dive platforms 12. Additionally, ties 70 are located through the upper hooks 24 for tying to a portion of the transom, swim or dive platform to 12 prohibit the ladder 10 from separating from the platform in the event of low tide or excessive turbulence.

The dismountable ladder 10 comprises a pair of similarly shaped vertical upper side members 20 for suspending horizontal steps 40 and 60 from a transom, swim or dive platform 12 which is attached to a boat (not shown). The upper end 22 of each upper side member 20 forms a U-shaped hook 24. In the preferred as shown, the U-shaped hook 24 is about 4 inches long about 2¾ inches wide and about ½ to ⅝ inches thick and the angle $\theta$ formed by the center line 26 of the upper side member 20 and the center line of the linear axis 28 of the slot 30 defined by the U-shaped hook 24 is equal to about between 25 and 35 degrees preferably about 30 degrees. Additionally, the hooks 24 depend downwardly for allowing the side members 20 to releasably receive a portion of a transon, swim or dive platform 12. The U-shaped hooks 24 allow the dismountable ladder 10 to pivotally attach to a portion of the transom, swim or transom, swim or dive platform 12 while maintaining complete portability of the dismountable ladder as a unit. Retainer bumps or keepers 32 are located at the ends 34 of the U-shaped hooks 24 for prohibiting the dismountable ladder 10 from inadvertently becoming disengaged from a portion of the transom, swim or dive platform step 12 due to low tide or excessive water turbulence.

Furthermore, the U-shaped hooks 24 facilitate storage of the ladder 10 by allowing the ladder to be swung upwardly about a portion of the transom, swim or dive platform 12 toward the boat (not shown) so that the ladder rests on top of the platform. The ladder 10 can remain in this position while the boat (not shown) is underway remaining ready for use without the need for dismounting or remounting the ladder. The ladder 10 may be swung downwardly away from the boat (not shown) so that the ladder will extend below the waterline to facilitate safe and convenient exit from or entry into the boat.

The lower end 36 of each upper side member 20 has openings 38 for receiving a horizontal upper step member 40 therein. The openings 38 have a rectangular shape for receiving a horizontal step member 40 in a manner that prohibits rotational movement by the step. When the dismountable ladder 10 is in a operable position, the openings 38 are offset laterally toward the user when compared to the portion of the transom, swim or dive platform 12 received by the U-shaped hooks 24. The positioning of the openings 38 allows the upper step member 40 to be placed in a position that allows the user to more easily climb the ladder 12.

Furthermore, screw holes 39 extend from interior of the openings 38 to exterior of the lower end 36 of the upper side member 20 to facilitate securing the step members 40 within the side member openings 38 to further prohibit movement by the step members 40. This arrangement prohibits the horizontal step members 40 from rotating when the ladder 10 is in use.

A horizontal upper step member 40 is releasably coupled within the opening 38 in the lower ends 36 of the upper side members 20. The step member 40 has a rectangular cross-section that is cooperable with the openings 38 in the upper side members 20 for limiting rotational movement by the step 40. The step member 40 provides a step to the user of the ladder 10 allowing easier and safer access to locations below the transom, swim or dive platform 12. The upper step member 40 has a plurality of screw holes 42 therein. The screw holes 42 allow the step member 40 to be secured to the upper side members 20 by screws 37 for precluding movement therebetween. The screw holes 39 further provide a method of joining the upper side members 20 and step members 40 in a manner that is easy and convenient to assemble and disassemble.

Screws 37 are provided for securing the upper step member 40 to the upper side members 20. The screws 37 extend through the screw holes 39 of the upper side members 20 and into the screw holes 42 within the upper step member 40. In the preferred embodiment as shown, the screws 37 are #10 stainless steel phillips panhead screws. The screws 37 allow the dismountable ladder 10 to be repeatedly assembled and disassembled easily within minutes.

To make access onto or from a boat (not shown) easier or safer, either from land or water, an additional interlocking step 60 may be added to the dismountable ladder 10. A pair of vertical lower side members 50 are provided for adding a step member 60 to the ladder 10. The upper end 52 of the lower side member 50 has openings 54 for receiving the horizontal upper step member 40. The openings 54 have a rectangular shape for receiving the horizontal step member 40. Because both the rectangular openings 54 in the lower side members 50 and the rectangular cross-sectional shape of the upper step member 40 are cooperable, rotational movement of lower side members 50 is precluded. Furthermore, screw holes 53 extend from interior of the openings 54 to exterior cf the upper end 52 of the lower side member 50 to facilitate securing the lower side members to the upper step member 40 to further prohibit movement by the lower side members. The screw holes 53 allow the lower side members 50 and the upper step member 20 to be joined in a fashion that easy and convenient to assemble and disassemble.

The lower end 57 of the lower of each side member 50 has openings 58 for receiving a horizontal lower step member 60 such that the lower step member is positioned forward of the upper step member 40. When the dismountable ladder 10 is in an operable position, the upper step member 40 is offset laterally toward the user when compared to the portion of the transom, swim or dive platform 12 received by the U-shaped hooks 24. Furthermore, the lower step member 60 is offset laterally toward the user when compared to the upper step member 40. The positioning of the step members 40 and 60 allows the user of the ladder 10 to more easily climb the ladder. The openings 58 have a rectangular shape for receiving a horizontal lower step member 60 in a manner that prohibits rotational movement by the step. The shape of the openings 58 precludes the lower step member 60 from rotating within the opening 58. Furthermore, screw holes 59 extend from interior of the openings 58 to exterior of the lower end 57 of the lower side member 50 to facilitate securing the step member 60 within the side member openings 58 to further prohibit movement by the step member 60. Additionally, the screw holes 53 and 59 provide a convenient and easy method of assembling and disassembling the lower side members 50 and lower step member 60.

A horizontal lower step member 60 is releasably coupled within the opening 58 in the lower ends 57 of the lower side members 40. The lower step member 60 has a rectangular crosssectional shape. The shape of the lower step member 60 is cooperable with the openings 58 in the lower side members 50. The cooperable shapes of the step member 60 and the side member 50 preclude rotation by the step. The step member 60 provides a step to the user of the ladder 10 allowing easier and safer access to locations below the transom, swim or dive platform 12. The lower step member 60 has a plurality of screw holes 42 therein. The screw holes 42 allow the lower step member 60 to be secured to the lower side members 50 and preclude movement therebetween and further provide a method of joining the members 50 and 60 in a manner that facilitates easy and convenient assembly and disassembly.

Screws 56 are provided for securing the lower step member 60 to the lower side members 40. The screws 56 extend through the screw holes 59 of the lower side members 50 and into the screw holes 42 within the lower step member 60. In the preferred embodiment as shown, the screws 37, 55 and 56 are #10 stainless steel phillips panhead screws. The screws 56 allow the dismountable ladder 10 to be assembled and disassembled easily and quickly, over and over again.

Screws 55 are provided for securing the lower side members 50 to the horizontal upper step member 40 through the screw holes 53 of the lower side members 50 and into the screw holes 43 within the upper step members 40. The screws 55 allow the dismountable ladder 10 to be assembled and disassemble simply and easily with ordinary handtools.

Additionally, keeper ties 70 are utilized for tying to a portion of the transom, swim or dive platform 12. The keeper ties 70 are coupled to the upper ends 22 of the upper side members 20 and are tied to a portion of the transom, swim or dive platform 12. The keeper ties 70 preclude the ladder 10 from separating from the transom, swim or dive platform 12 during use of the ladder. Furthermore, the keeper ties 70 allow the dismountable ladder 10 to be upwardly rotated about a portion of a transom, swim or dive platform 12 without becoming detached from the platform to facilitate storing the ladder on top of the platform.

The dismountable ladder 10 may have horizontal step members 40 and 60 with a plurality of screw holes 42. The plurality of screw holes 42 provide enable the dismountable ladder 12 to have an adjustable width between the side members 20 and 50. Each side of the step member 40 and 60 has a plurality of holes 42 at each end. The plurality of screw holes 42 allow the side members 20 and 50 to be positioned with a variety of distances therebetween allowing the dismountable ladder 10 to fit a wide variety of transom, swim or dive platforms 12.

Finally, in the preferred embodiment as shown, the vertical side platform members 20 and 50 and step members 40 and 60 are constructed of a hard, rigid, water resistant, solid plastic. Sanelite manufactured by E.I.-DuPont De Nemours, Inc. of Wilmington, Del. is an example an acceptable plastic material.

Although any one supplemental lower step 60 is illustrated, any number of lower steps may be added therebeneath through supplemental similar side members 50 and steps 60.

The present disclosure includes that contained in the appended claims as well as that of the foregoing description. Although this invention has teen described in its preferred form with a certain degree of particularity, it is understood that the present disclosure of the preferred embodiment has been made by way of example only and that numerous changes in the details of construction and the combination and arrangement of parts may be restored to without departing from the spirit and scope of the invention.

Now that the invention has been described,

What is claimed is:

1. A dismountable ladder for use with dive platforms, comprising in combination:

a pair of similarly shaped vertical upper side members, the upper end of each upper side member being shaped as a downwardly facing U-shaped hook means adapted to releasably receive a portion of a dive platform, the lower end of each upper side member having opening means with screw holes extending from interior of the opening means to exterior of the lower end of the upper side member;

a horizontal upper step member releasably coupled within the opening in the lower ends of the upper side members, the upper step member having a plurality of screw holes therein; and screw means for securing the upper step member to the upper side members through the screw holes of the upper side members and upper step member.

2. The ladder as set forth in claim 1, and further including:

a pair of similarly shaped vertical lower side members, the upper end of each lower side member having opening means for receiving the horizontal upper step member with screw holes extending from interior of the opening means to exterior of the upper end of the lower side member, the lower end of the members having opening means for receiving a horizontal lower step member such that the lower step member is positioned forward of the upper step member during operation and use with screw holes extending from interior of the opening means to exterior of the lower end of the lower side member;

a horizontal lower step member releasably coupled within the openings of the lower ends of the lower side members, the lower step member having a plurality of screw holes therein for securing the lower step member to the lower side members; and screw means for securing the lower step member to the lower side members and for securing the lower side members to the horizontal upper step member.

3. The ladder as set forth in claim 1, and further including keeper means for tying to a portion of a dive platform for precluding the ladder from separating from the dive platform.

4. The ladder as set forth in claim 1, wherein each side of the step member has a plurality of holes at each end thereby allowing the side members to be positioned with a variety of distances therebetween.

5. The ladder as set forth in claim 1, wherein the tip of the end of the U-shaped hook means has a bump thereon.

6. The ladder as set forth in claim 1, wherein the angle $\eta$ formed by the center line of the upper side member and the center line of the linear axis of the slot defined by the U-shaped hook means is about 30 degrees.

7. The ladder set forth in claim 1, wherein the screw means are two number 10 stainless steel phillips panhead screws per step.

8. The ladder as set forth in claim 1, wherein the vertical side platform members and step members are constructed of a solid plastic material.

9. A dismountable ladder for use with dive platforms, comprising in combination:

a pair of similarly shaped solid plastic vertical upper side members, the upper end of each upper side member being shaped as a downwardly facing U-shaped hook means adapted to releasably receive a portion of a dive platform wherein the angle>> formed by the center line of the upper side member and the center line of the linear axis of the slot defined by the U-shaped hook means is between about 25 and 35 degrees and further having a bump on the tip of the U-shaped hook means, the lower end of each upper side member having opening means with screw holes extending from interior of the opening means to exterior of the lower end of the upper side member;

a pair of similarly shaped solid plastic vertical lower side members, the upper end of each lower side member having opening means for receiving the horizontal upper step member with screw holes extending from interior of the opening means to exterior of the upper end of the lower side member, the lower end of the members having opening means for receiving a horizontal lower step member such that the lower step member is positioned forward of the upper step member during operation and use with screw holes extending from interior of the opening means to exterior of the lower end of the lower side member;

a solid plastic horizontal upper step member releasably coupled within the opening in the lower ends of the upper side members, the upper step member having a plurality of screw holes therein at each end for allowing the side members to be positioned with a variety of distances therebetween;

a solid plastic horizontal lower step member releasably coupled within the openings of the lower ends of the lower side members, the lower step member having a plurality of screw holes therein at each end for allowing the lower side members to be positioned with a variety of distances therebetween;

screw means for securing the upper step member to the upper side members through the screw holes of the upper side members and upper step member and for securing the lower step member to the lower side members and for securing the lower side members to the horizontal upper step member; and keeper means for tying to a portion of a dive platform for precluding the ladder from separating from the dive platform.

* * * * *